United States Patent [19]

VanderLugt, Jr.

[11] 4,363,821

[45] Dec. 14, 1982

[54] METHOD OF PACKAGING ICE CREAM IN A CLOSABLE CONTAINER

[75] Inventor: Thomas VanderLugt, Jr., Kalamazoo, Mich.

[73] Assignee: James River Corporation of Virginia, Richmond, Va.

[21] Appl. No.: 186,616

[22] Filed: Sep. 12, 1980

Related U.S. Application Data

[62] Division of Ser. No. 71,242, Aug. 30, 1979.

[51] Int. Cl.[3] ..... B65B 7/28; A23L 3/36

[52] U.S. Cl. ..... 426/393; 53/440; 53/456; 53/486; 53/487; 426/106; 426/130; 426/397; 53/488

[58] Field of Search ..... 426/130, 393, 106, 397; 229/43, 37 E, 39, 32, 41; 53/440, 456, 486, 487, 488

[56] References Cited

U.S. PATENT DOCUMENTS

| | | | |
|---|---|---|---|
| 2,562,579 | 7/1951 | Ringler | 229/37 E |
| 2,990,998 | 7/1961 | Barclay | 229/43 |
| 3,307,739 | 3/1967 | Cloyd et al. | 229/43 |
| 3,317,109 | 5/1967 | Palmer | 229/515 |
| 3,516,572 | 6/1970 | Davis | 229/43 |
| 3,547,336 | 12/1970 | Jacke | 229/43 |
| 3,613,940 | 10/1971 | Davis | 229/43 |
| 3,642,194 | 2/1972 | Scully | 229/45 |
| 3,722,731 | 3/1973 | McCormick et al. | 229/43 |
| 3,756,493 | 9/1973 | Holmes | 229/515 |
| 3,899,117 | 8/1975 | Peyser | 229/43 |
| 3,942,712 | 3/1976 | Bundy et al. | 229/45 R |
| 3,986,659 | 10/1976 | Vajtay | 229/43 |

FOREIGN PATENT DOCUMENTS

| | | | |
|---|---|---|---|
| 2261188 | 9/1975 | France | 229/37 E |

*Primary Examiner*—Steven L. Weinstein
*Attorney, Agent, or Firm*—Gordon W. Hueschen

[57] ABSTRACT

A novel ice cream product container with complementary closure member is disclosed. The container body member is usually of paperboard and formed from an integral blank comprising edge-reinforcing flaps articulated to wall members, which reinforcing flaps are then folded down upon and secured to their respective wall members to provide a reinforced portion of double thickness in the container formed from the blank. This folded-over, reinforced portion is also present in the flat-folded tube produced from the blank, the squared-up tube, the erected container, and finally in the closed and filled package. This folded-over, reinforced portion of double thickness contains defined areas of low resistance adapted to receive lugs formed in a wall of the complementary closure member. The closure member also provides a complementary channel between essentially upstanding and downstanding walls for receiving the reinforced portion of the container walls in frictional engagement therewith. The defined areas of low resistance in the upper edge areas of the container walls may be provided by cuts or cut-outs, preferably of a generally inverted-V shape, and the corresponding lugs formed in the complementary closure member are complementarily shaped to provide excellent releasable securement of the closure member to the container walls. The combination of the container and complementary closure member, method of closing the container with the complementary closure member, and method of packaging ice cream product therein are also disclosed and form a part of the invention.

7 Claims, 23 Drawing Figures

METHOD OF PACKAGING ICE CREAM IN A CLOSABLE CONTAINER

This is a division of application Ser. No. 71,242, filed Aug. 30, 1979.

BACKGROUND OF THE INVENTION (1) Field of Invention

Ice cream product or produce containers, including combination of container body and closure member, blanks from which such container body may be erected, such containers erected and filled with ice cream product and closed with such closure member; such containers partially erected in the form of a tube open at both ends, closed at one end by bottom-forming members, or closed at one end by said closure member; method of closing such containers by means of closure members particularly adapted for such purpose. Also, such containers which may be readily constructed of inexpensive sheetform materials such as paperboard and such closure members which may be readily constructed from plastic materials, and the combination of which container and closure member has numerous advantages which will appear from the following. Methods of packaging ice cream product or produce.

(2) Prior Art

Ice cream products, including sherbets, milk ice, ices, and related products, have long been packaged in containers of various types and sizes, including numerous forms and shapes of paperboard and, rather recently, tub-type cylindrical cartons of the type historically employed for cottage cheese and the like, with a single paperboard sheet closing the upper circular area thereof. Although such latter types of containers are structurally sound, they are extremely expensive and do not solve the problems of vapor-transfer or stability once opened. Moreover, they are bulky and spacewasting at all marketing and consumer levels. Existing ice-cream carton structures, with or without tearstrips, are likewise characterized by numerous shortcomings, not the least of which is the expense, due to the relatively high caliper of paperboard which must be employed. In addition, since these are all made of integral blanks, any cover member must of necessity be hinged from the bottom or carton body along the edge of the rear wall of the carton body, which makes it impossible to provide any substantial friction between the carton cover and the carton body along the front wall. In addition, even when higher caliper sheetform material is employed of the paperboard type, once a carton is opened, moisture vapor and fluid content of the carton penetrate the raw edge of the carton body, with the result that the carton takes on a shabby and inelegant appearance and, moreover, produces less and less of a barrier to the outside atmosphere as the penetration into the raw edge of the paperboard increases and deterioration and leakage progresses. Moreover, even with higher caliper board, due to usual pressures occurring in storage and in use, the carton body does not remain stable and, even under normal conditions of use, frequently assumes a flimsy, bowed, nonsupportive and grossly inelegant condition.

It is an objective of the present invention to provide an ice cream product container with complementary container closure member which is as elegant in appearance as the classic cylindrical containers, but which is not subject to any of the foregoing disadvantages, including economic disadvantages, thereof. In addition, it is an object of the invention to provide an ice cream product container constructed from an integral blank, and a cover formed from plastic, and combination thereof by securement of the closure member to the container body in such a manner and according to such a structure whereby all of the aforementioned disadvantages of prior art paperboard ice cream carton structures are genuinely avoided and a novel, unique, and and elegant type of ice cream product container thereby provided.

OBJECTS OF THE INVENTION

It is, accordingly, an object of the present invention to provide a novel, top-opening ice cream product container which may be closed and subsequently opened by the removal of the closure member of the invention, which may be readily reclosed when it is desired to store unconsumed contents, which is comprised of an individual container body provided from an integral cut and scored blank and an individual cover of plastic material, and which is in appearance and elegance comparable to the cylindrical cartons presently in use but which avoids the aforesaid economic and leakage disadvantages thereof, and which moreover avoids the disadvantages of inelegance, structural instability, leakage, deterioration of raw edges of carton body due to infiltration or penetration of moisture, moisture vapor, and fluid contents of the carton, and which, due to the fact that the container closure member is provided as a separate unit and is not made from the same integral blank as the container body, permits the provision of unprecedented friction and therefore also an unprecedented close fit between the container closure member and the container body member along all edges of the opening end of the container both as constituted initially and also upon reclosure. Moreover, with the container of the present invention, there is no wasted space, either in shipment or in storage, since the container is generally of a rectangular cross-section allowing economic utilization of all available space, on the shelves of both the consumer and the vendor. In addition, the novel closure, opening, and reclosure feature of the present invention eliminates many of the closure and leakage problems inherent in previously available ice cream cartons and containers of other types. The provision of a unique method of closing a container of the present invention with a container closure member of the present invention, and a method of packaging ice cream products therein, as well as intermediate forms of the container blank, with and without closure member and or bottom, and the blank itself are additional objects of the invention which have been fully accomplished thereby. The accomplishment of the foregoing and additional objects will become more fully apparent hereinafter, and still other objects will be apparent to one skilled in the art to which this invention pertains as the description proceeds.

SUMMARY OF THE INVENTION

The invention, in brief, comprises a new and improved more elegant container for the containment and packaging of ice cream products. According to the invention, the container body member is formed from an integral blank, usually of paperboard, and the complementary closure member is formed of a sheetform material, generally a thermoplastic, and the two members are subsequently secured to each other. The manner in which they are secured to each other is novel and significant. The blank from which the container is constructed comprises edge-reinforcing flaps articulated to panel or wall members of the container blank, which are folded down upon their respective wall or panel member and adhesively secured thereto to provide a folded-over, reinforced portion of double thickness, which first appears in the container blank, then in the tube produced when the blank is folded over and adhered to itself along the manufacturer's glue seam, then in the squared-up tube erected therefrom, and finally in the closed container. Whether the container closure member, having complementary features, is employed to close this reinforced end of the carton or carton blank before or after closure and adherence of the bottom-forming flaps at the other end thereof, the frictional fit provided between this folded-over reinforced portion of double thickness in the container body and the complementary closure member is indeed an excellent closure for a container designed to contain ice cream product. In addition, in the said folded-over, reinforced portion of double thickness, there are provided defined areas of low resistance which are adapted to receive lugs formed in a wall of said closure member which comes into juxtaposition with said folded-over, reinforced portions of the container walls, so that the lugs in said closure member can complementarily extend into the said areas of low resistance in the inner exposed surface of the walls of the container at the end thereof which is closed by the closure member. The said lugs may also be adhesively secured in said areas of low resistance for better releasable securement of the closure member to the container walls, as will appear more fully hereafter. The structure described is an integral part of the present invention in all of its aspects, and permits the attainment of unprecedented elegance, closure, opening, and reclosure characteristics, without undesirable leakage and with retention of the basic container form, structure, and elegance, throughout the period of its use and until the exhaustion of its content and even beyond.

The container body is unique in its structure in that it includes, as already described, articulated to each of its generally rectangular walls, but adhesively secured to the said walls, the folded-over, reinforcing portion of double thickness for stabilization and edging purposes, as well as for provision of the stated areas of low resistance to receive the complementary lugs formed in an upstanding tubular inner wall of the unique closure member of the invention, which comes into juxtaposition with the folded-over edge-reinforced portions of the walls of the container upon closure thereof with said closure member. The container body also comprises bottom flaps, which are generally the last to be closed in the erected container, but which may be closed before the closure member is used to close the reinforced end thereof. In a preferred embodiment, the container of the invention, and its preferred manner of utilization, is unique in that it is fully assembled except for closure of its bottom flaps before filling, whereafter the bottom flaps are closed and secured. In this embodiment of the invention, the novel closure member of the invention is secured to the reinforced end of the squared-up tube constructed from the starting container blank before the filling operation commences. Other aspects of the various structures and procedures of the present invention, and advantages, will become apparent hereinafter but, all in all, the combination of the independent but integrally cooperating container closure member and the container body, the integral blanks for forming the said container body, the unique aspects of the container body and its reinforcing double edge, and especially the combination of the two into an integral unit, the complete ice cream-product containing package, and the unique method of assembly, filling, and packaging, all provide novel and unique contributions to the art of ice cream packaging, which will now be more particularly described.

DESCRIPTION OF THE PREFERRED EMBODIMENTS OF THE INVENTION

The invention, in several preferred embodiments is illustrated by the accompanying drawings, in which.

Figure 6C:
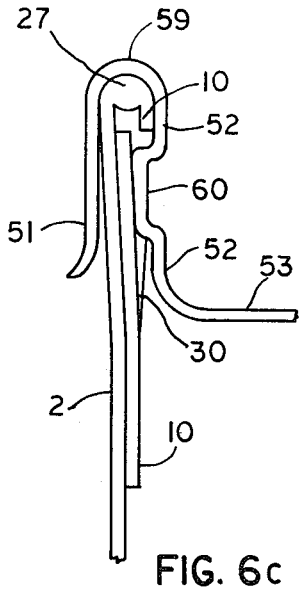
FIG. 6 is a partially cut away side view of the container of FIG. 5 with closure member in place, having previously been filled with content.
Figure 6:
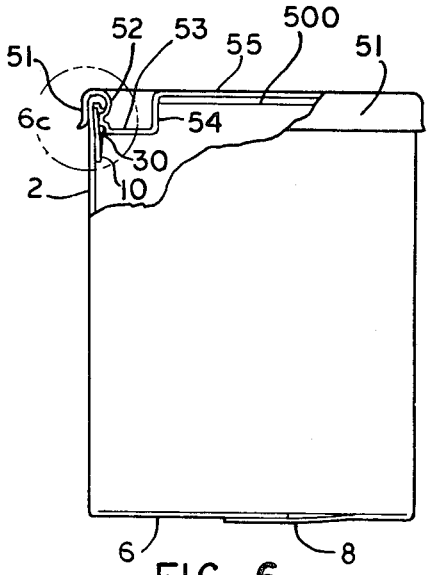

FIG. 6*c* is an enlarged cross-sectional view of the section 6*c* identified in FIG. 6 showing details of the means whereby the container closure member is removably secured to the container.

Figure 4:
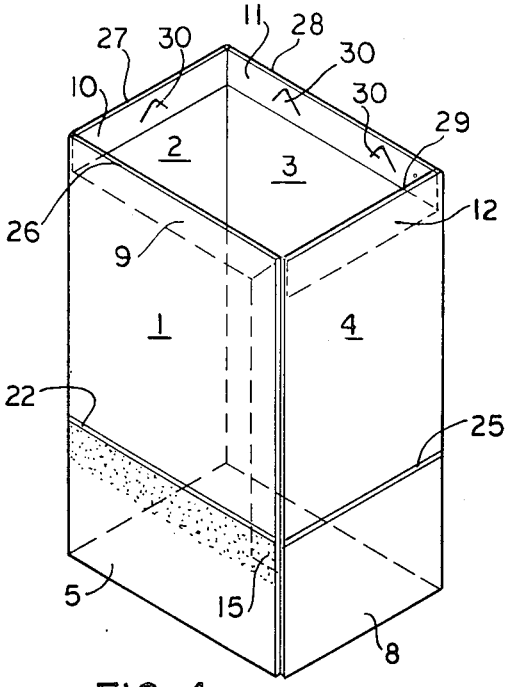
FIG. 4 is a perspective view of the blank of FIG. 3 partially glued and in the form of an erected sleeve or tube.
Figure 5:
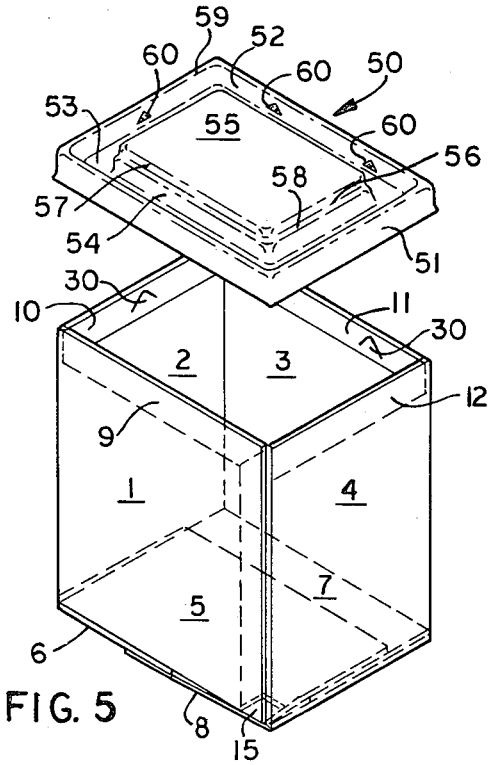
FIG. 5 is a perspective view of the tube of FIG. 4 with its bottom-forming flaps closed and adhered to form a container and with its complementary closure member about to be placed thereon.
Figure 5A:
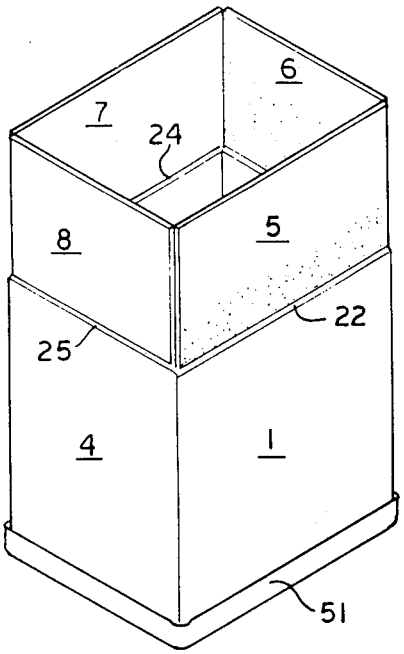

FIG. 5*a* is a perspective view of the tube of FIG. 4 in reversed position with its top end down and closed by the closure member shown in FIG. 5.

Figure 6A:
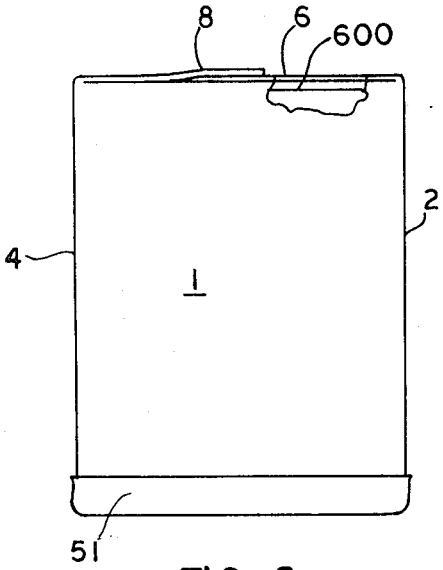

FIG. 6*a* is a side view of the upside down container of FIG. 5*a* after having been filled with content and having its bottom-forming members folded upon and adhered to each other to form a closed container.

Figure 7:
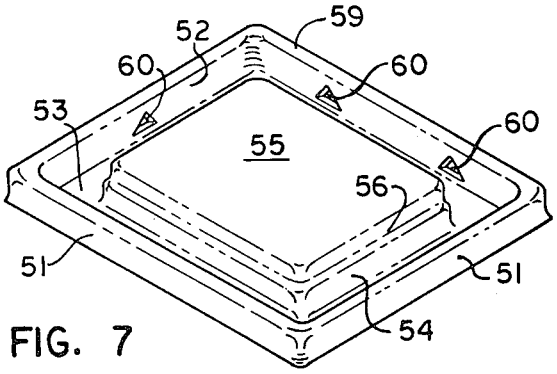

FIG. 7 is a top perspective view of a closure member according to the invention.

Figure 8:
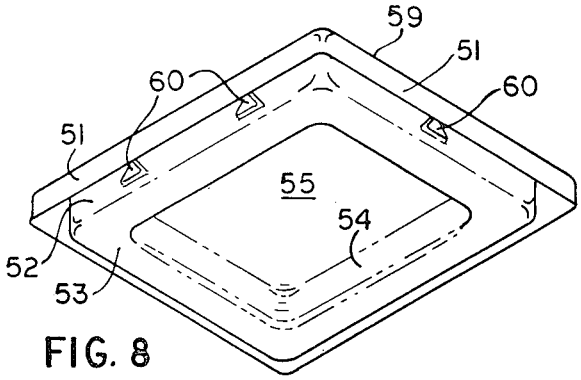

FIG. 8 is a bottom perspective view of the closure member of FIG. 7.

Figure 9:
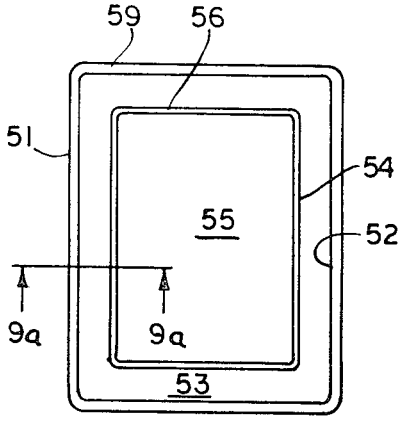

FIG. 9 is a top plan view of two closure members of FIG. 7 nesting in vertical juxtaposition.

Figure 10:
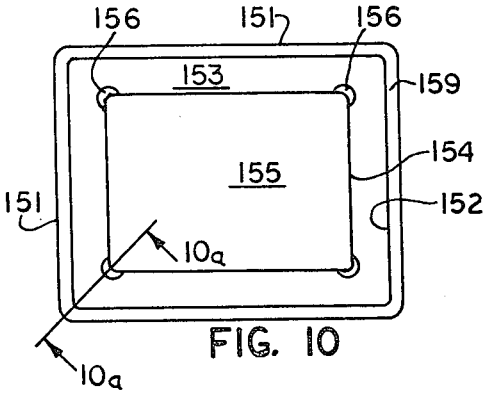

FIG. 10 is a top plan view of another embodiment of the closure member, two such members being nested in vertical juxtaposition.

Figure 11A:
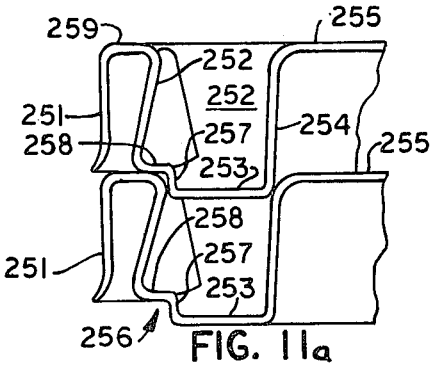
Figure 11:
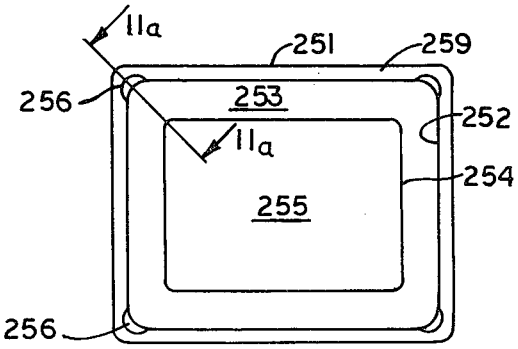

FIG. 11 is a top plan view of still another embodiment of the closure member, two such members again nesting in vertical juxtaposition.

Figure 9A:
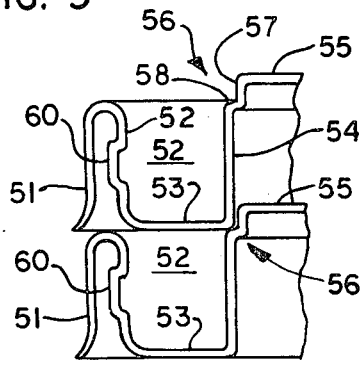
Figure 10A:
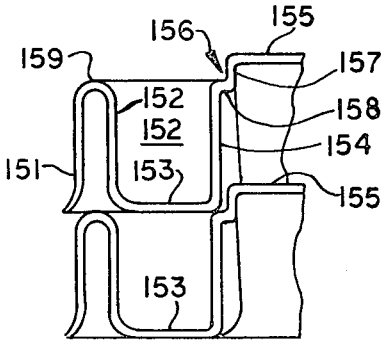

FIGS. 9*a*, 10*a*, and 11*a* are respectively cross-sectional views along lines 9*a*, 10*a*, and 11*a* of FIGS. 9, 10, and 11, each showing details of the two closure members nesting in vertical juxtaposition.

Figure 13:
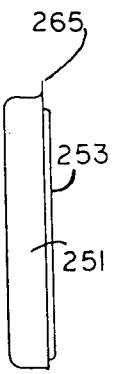
Figure 12:
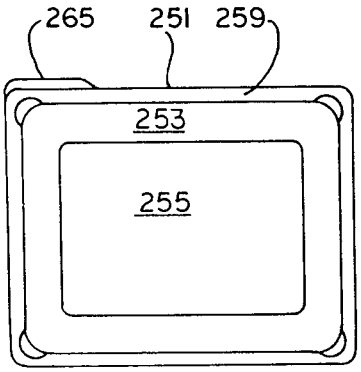
Figure 15:
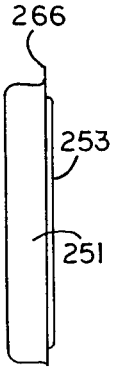
Figure 14:
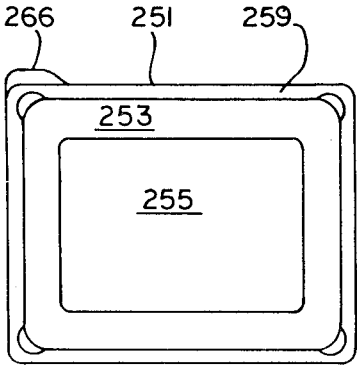

FIGS. 12 and 14 are top plan views of still additional embodiments of the closure member of the invention, having a pull tab for facilitating opening of a container closed therewith, and FIGS. 13 and 15 are respectively side views of the closure members of FIGS. 12 and 14.

Figure 3:
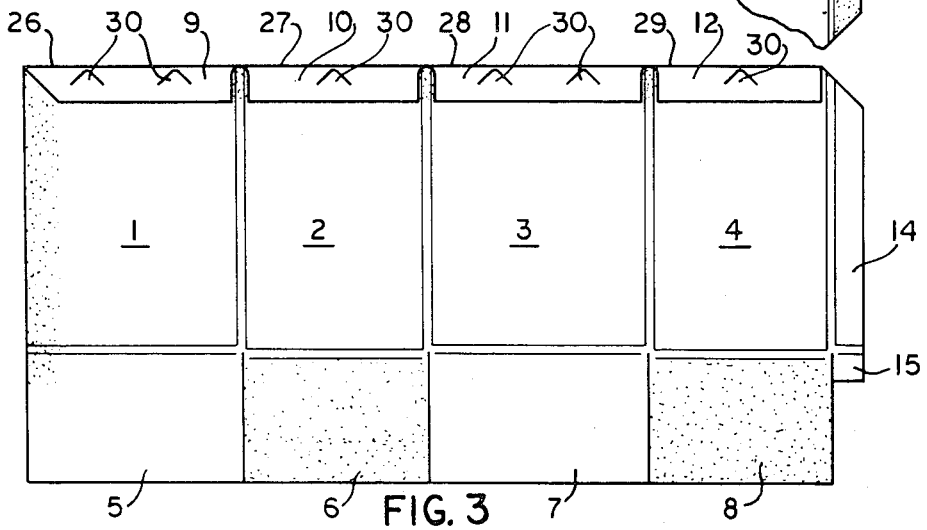
FIG. 3 is a plan view of the blank of FIG. 1 with the edge-reinforcing flaps folded over and adhered in reinforcing position to provide a double thickness at that end of the blank.
Figure 16:
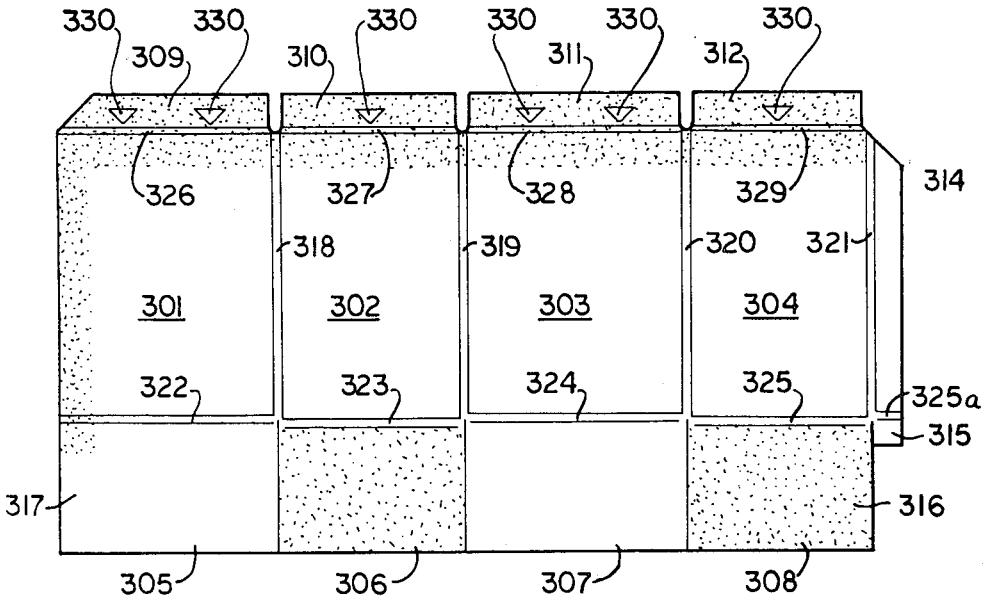
Figure 17:
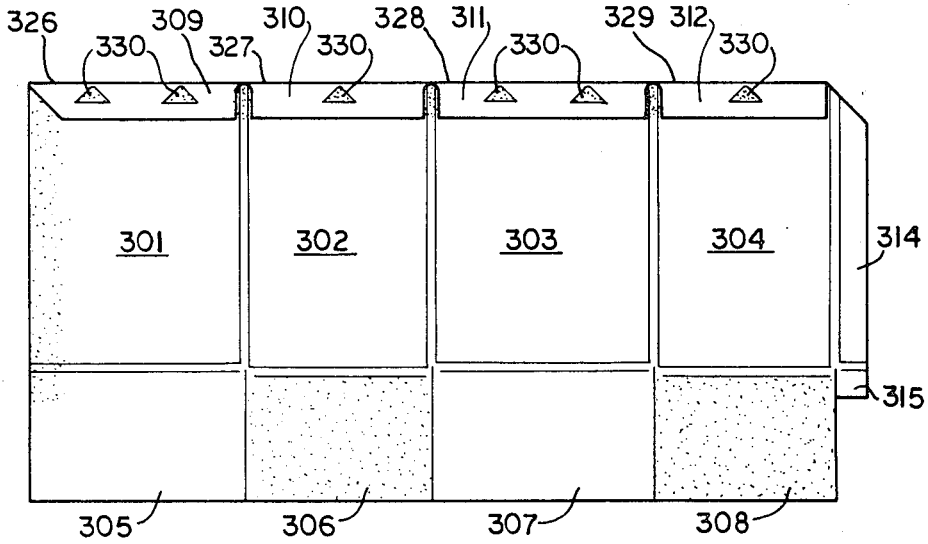

FIG. 16 is a plan view of the inside of another container blank according to the invention, having different areas of low resistance in the edge-reinforcing flaps, and FIG. 17 is a plan view of the blank of FIG. 16 with the edge-reinforcing flaps folded over and adhered as in FIG. 3.

SPECIFIC REFERENCE TO THE DRAWINGS

Reference is now made to the accompanying drawings for a better understanding of the invention, wherein all the parts are numbered and wherein the same numbers are used to refer to corresponding parts, or wherein the same numbers but differing by a factor of one hundred (100) are used to refer to corresponding parts.

Figure 1:
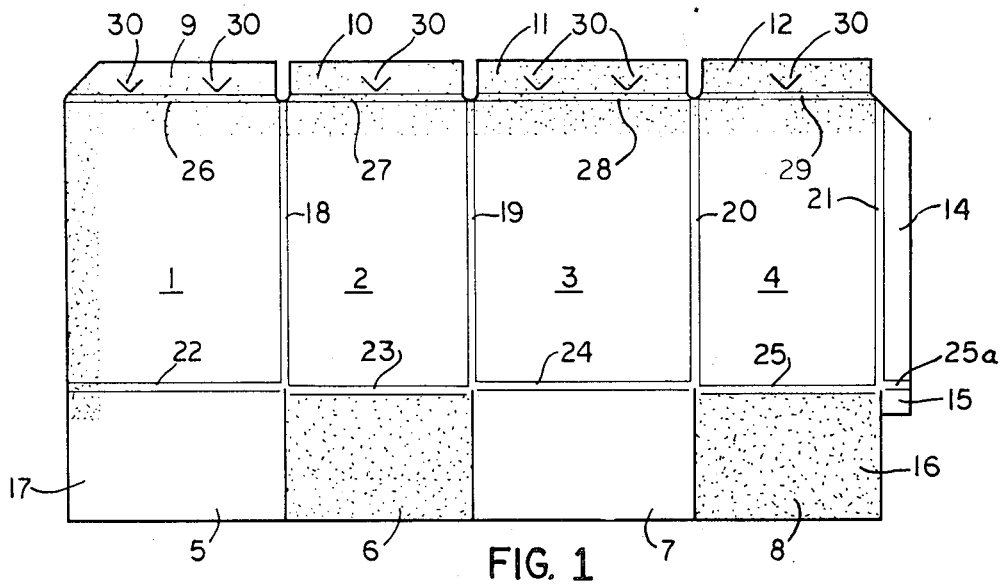
FIG. 1 is a plan view of a cut and scored blank for forming a container having the novel features according to the invention, viewed from the inside surface thereof.

In a preferred form, the container of the invention may be constructed from an integral blank as illustrated in FIG. 1, the blank of FIG. 1 generally being constructed of paperboard and preferably waxed both internally and externally except in the areas where adhesive is or is to be applied during erection into a completed container. The blank comprises rear, side, front, and side panels or walls 1, 2, 3, and 4, and glue-flap 14, respectively articulated to each other along crease scores 18, 19, 20, and 21. Bottom-forming flaps 5, 6, 7, and 8 are respectively articulated to their main carton panels or walls along crease scores 22, 23, 24, and 25, and glue-flap extension 15 is articulated to glue flap 14 along crease score 25*a*. The stippled areas are unwaxed in view of the fact that they are or will contain adhesive during the process of erection of the blank into a container, and the unstippled areas are generally and preferably coated with wax. The stippled areas are representatively indicated at 16 and the waxed areas at 17.

Articulated to the top edges of the main container panels or walls along crease scores 26, 27, 28, and 29 are edge-reinforcing flaps 9, 10, 11, and 12, adapted to be folded over upon the inner surfaces of their respective main wall panels and adhered thereto. In these said edge-reinforcing flaps are located areas of low resistance, in FIG. 1 shown as generally V-shaped cuts 30, one being located in each of side panels 2 and 4 and two such cuts being located in each of rear and front panels 1 and 3, the same cuts 30 designed to become inverted-V-shaped cuts when the edge-reinforcing flaps 9 through 12 are folded over and adhered to their respective main container wall panels. These areas of low resistance may take various forms and configuratons, as will appear hereinafter, e.g., in FIGS. 16 and 17.

It will be apparent to one skilled in the art from FIG. 1 that glue flap 14 and its extension 15 could equally well be articulated to one side edge of rear wall panel 1, or that the wall panels could be differently arranged to give the same result upon erection.

In erecting a container from the blank of FIG. 1, the bottom-forming flaps 5 through 8 are folded in in usual manner. Ordinarily, for convenience, the sequence is 5, 7, 6, and 8, the outer bottom-forming flap 8 being folded in last into juxtaposition with bottom-forming flap 6 and into overlapping position with respect thereto, as will be apparent from subsequent Figs.

Figure 2:
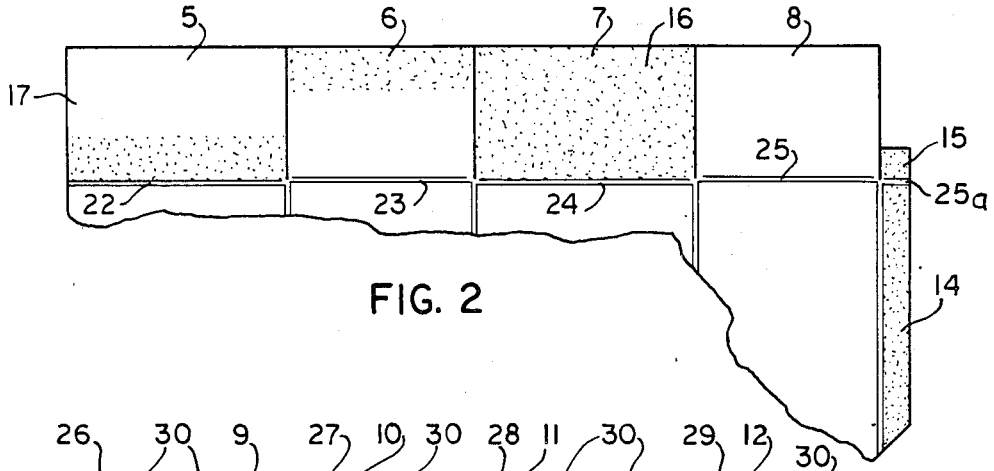
FIG. 2 is a partial plan view of the blank of FIG. 1 viewed from the outside.

Whereas FIG. 1 illustrated the side of the blank adapted to be inside the container erected therefrom, FIG. 2 is precisely the same blank, viewed from the outside. FIG. 3 again shows the inside of the blank, with the edge-reinforcing flaps 9 through 12 folded over into reinforcing position to provide a double thickness of the material of construction at that end of the container, flaps 9 through 12 now being adhered to the respective main container panels or walls to which they are articulated, and the areas of low resistance in the said edge-reinforcing flaps 9 through 12 now being in the form of an inverted V, in which form they will appear in the completely erected container.

The blank of FIG. 3 is then erected into a flat-folded tube by folding over the glue flap 14 upon its adjacent wall panel 4 and then folding over side and rear panels along score 19, so as to bring the edge of rear panel 1 into juxtaposition with the dry side of glue flap 14. In this position the inside of wall panel 1 is secured by any suitable adhesive to the folded over outside of glue flap 14, thereby forming the flat-folded tube which is sealed to itself along the proverbial manufacturer's glue strip, and which may be shipped to the trade for erection by squaring up into a tube as shown in FIG. 4, all the elements being the same in FIG. 4 as in FIG. 3. Alternatively and preferably, the folds are made at scores 18 and 20 instead of 19 and 21.

In one manner of proceeding, the bottom flaps are then closed upon each other first, to form a bottom and produce a container with upstanding walls having reinforced edges, as shown in FIG. 5. As shown and as previously indicated, the folding sequence of the bottom-forming flaps is 5, 7, 6, and 8, secured to each other to form a bottom by means of suitable adhesive of any type placed or preplaced into the dry areas thereof in the usual manner.

In FIG. 5 the container closure member of the invention is shown about to be placed upon the reinforced edges of the upstanding walls of the container. In this view of the closure member, identified generally at 50, upstanding tubular inner wall conforming to the inner surfaces of the tubular container walls to be closed by said closure member is identified at 52, with downstanding tubular outer wall connected thereto by a bight 59 and conforming to the outer surfaces of the tubular container walls of the container to be closed by the closure member being identified at 51. Centrally-located upwardly elevated dome portion 55 is defined by upstanding dome-forming wall 54 which is inwardly spaced from upstanding tubular inner wall 52, the said two upstanding walls thereby defining a tubular valley 53 therebetween. The bight 59 constitutes the outer top edge of the channel formed by said upstanding wall 52 and downstanding wall 51, in which the upstanding walls 1, 2, 3, and 4 of said tubular container can be seated in frictional engagement. Said bight constituting said top edge of said tubular channel in which the upstanding walls of the tubular container can be seated may be in the form of a corner, bend, angle, or curve, but in any event constitutes the outer top edge of the said channel formed by upstanding wall 52 and downstanding wall 51.

Clearly visible in upstanding wall 52 of closure member 50 are lugs, fingers, detents, or prongs 60, hereinafter referred to as lugs. Also visible in FIG. 5 are nesting means to facilitate vertical stacking or feeding of a plurality of closure members 50 in the form of a step 56 having a vertical riser 57 and a horizontal tread 58, in this embodiment the said step being formed in the upstanding dome-forming wall 54. As will be seen hereinafter, this step 56 may also conveniently be formed in the other of the upstanding walls defining the tubular valley 53, namely, in inner upstanding wall 52. In the embodiment shown in FIG. 5, lugs are in the form of an inverted V triangle, to generally corespond with the inverted V cuts 30 located in the reinforced edges of the container walls, said reinforced edges being provided by means of edge-reinforcing flaps 9–12.

After filling of the container of FIG. 5 with semi-solid ice cream product prior to closing of the same with the closure member 50 of the invention, the finished package is shown in FIG. 6. Ice cream product 500 will be in either semi-solid or solid form, depending upon whether the package of FIG. 6 has or has not been yet subjected to the "hardening room", as will be described further hereinafter. All of the elements already described in FIG. 5 are apparent in FIG. 6, including upwardly elevated dome portion of the closure member at 55, downstanding wall 51, dome-forming wall 54, upstanding inner wall 52, folded-over edge-reinforcing flap 10 shown adhered to its adjacent container wall panel 2, and the bottom-forming panels in their respective closed and adhered condition. The area of low resistance in edge-reinforcing flap 10 is show at 30 and the section *6c*, taken through this area of weakened resistance 30 and lug 60, is shown in enlarged detail in FIG. *6c*. Most of the elements previously described in FIG. 6 are immediately apparent from FIG. *6c*, including, in clockwise order, container wall 2, closure member downstanding outer wall 51, crease score 27, now constituting an upper edge of the container wall, bight 59 constituting the outer top edge of the channel in which the upstanding wall 2 of the container is seated in frictional engagement, said channel being comprised by downstanding outer wall 51 and upstanding inner wall 52. Edge-reinforcing flap 10 is shown within said channel, with lug 60 forcing back area of low resistance 30, thus securing closure member 50 to upstanding wall 2 of the container. A portion of valley 53 is also shown in the enlarged detail of FIG. *6c*.

FIG. *5a* is the same as FIG. 5, except reversed, that is, showing an embodiment in which the closure member has been placed upon the reinforced edges of the container walls of a tube of FIG. 4 prior to closing the bottom-forming members of the said tube. In this embodiment of FIG. *5a*, then, the "upside down" version of the embodiment shown in FIG. 5, the bottom closure flaps are outwardly extending and in an unfolded and non-secured position, and the reinforced end of the tube of FIG. 4 is closed by the closure member 50 as shown in FIG. 5. Aside from the container wall and the outwardly extending unfolded and non-secured bottom-forming flaps, only the ordinarily downstanding outer wall 51 of closure member 50 is visible.

FIG. *6a* shows the container of FIG. *5a* after filling with semi-solid ice cream product and closure and adherence of the bottom-forming flaps thereof. The ice cream product in this embodiment completely fills the dome of the closure member, and is shown in the partially cut-away section as 600.

FIGS. 7 and 8 respectively show the top perspective and bottom perspective of the closure member 50 as first shown and described for FIG. 5. The elements are the same and lugs 60 are apparent in both views, said lugs being in the form of triangles preformed in the inner upstanding wall 52 of the closure member so as to coincide with inverted-V-shaped areas of low resistance in edge-reinforcing flaps 9–12, now constituting the inner edge of the container body. FIG. 9 is a top plan view of the closure member, as well as two such closure members stacked in vertical juxtaposition. FIG. *9a* is a cross-sectional view along line *9a—9a* of FIG. 9, showing all the elements as previously described, including the step 56 and its horizontal tread 58 and vertical riser 57 and how these cooperate in two vertically-juxtaposed closure members of the invention for stacking or nesting purposes.

FIGS. 10 and 11 are top plan views of additional embodiments of the closure member of the invention, as well as two such closure members stacked in vertical juxtaposition. Cross sections thereof are shown respectively in FIGS. 10*a* and 11*a*, in which all of the elements are correspondingly numbered identically but in the 100 and 200 series. Once again, the step for nesting or stacking purposes is located in one of the upstanding walls defining the tubular valley, in FIGS. 10 and 10*a* in upstanding dome-forming wall 154, where step 156 is provided with vertical riser 157 and horizontal tread 158, and in FIGS. 11 and 11*a* in upstanding tubular inner wall 252 where step 256 is provided by means of vertical riser 257 and horizontal tread 258. The risers and treads providing such steps need of course only be generally vertical and generally horizontal so as to permit the desired nesting, as shown.

FIGS. 12 and 14 are top plan views of additional embodiments of the closure member of the invention, being identical with the version of FIGS. 11 and 11*a* with the exception of pull-tabs 265 and 266, having slightly different configurations, which are provided in the downstanding outer wall of the closure member at the outer or lower edge thereof. As will be noted from FIGS. 13 and 15, respectively side views of the closure members of FIGS. 12 and 14, as well as from all of the other views of the closure member 50 of the invention, the same is generally and preferably provided with an outwardly flaring skirt portion in its downstanding outer wall 51, 151, 251 to facilitate placement thereof on a container. Also, as will be noted from FIGS. 12 and 14, as well as from FIGS. 10, 10*a*, 11, and 11*a*, it is not necessary that the step designated 56 in FIG. 9 be provided entirely around the periphery of upstanding tubular inner wall 52, 152, 252 or upstanding dome-forming wall 54, 154, 254, since such step may be present in one of said walls at only a limited portion thereof, for example at corner 156 or 256, as particularly apparent from FIGS. 10, 11, 12, and 14.

FIG. 16 shows another blank of the same type as shown in FIG. 1, also viewed from the side which will be the inside of a container formed therefrom, differing from the blank of FIG. 1 essentially in that areas of low resistance 330 formed in edge-reinforcing flaps 309–312 are in the form of generally V-shaped cut outs, rather than mere cuts 30 as provided in the blank of FIG. 1.

Upon folding over these edge-reinforcing flaps 309–312, and adhering them to adjacent container walls 301–304, excess adhesive appears in the cut-out areas of low resistance 330 which, especially if heat-activatable or hot-melt adhesive, may serve the further function of at least temporarily adhering lugs 60 of the closure member therein, as will be more fully described hereinafter.

It should be apparent to one skilled in the art that these areas of low resistance provided in the edge-reinforcing flaps 9–12 and 309–312 may take any one of a large number of shapes, forms, or configurations and, whether cuts or cut outs, may also provide access to excess adhesive therein by the lugs of the complementary closure member. Additional configurations of cuts 30 or cut outs 330 may, for example, be diamond or partial diamond, square, arcuate, oblong, circular, and so on. In each case the complementary lug is advantageously and preferably similarly shaped. However, for best results, it has been found that a V-cut, constituting an inverted V-cut in the finished container, or a V-shaped cut out, constituting an inverted-V-cut out in the finished container, are advantageous and preferable, inasmuch as such configuration permits excellent interlocking between the corresponding and preferably complementarily-shaped lugs of the closure member and the said cuts or cut outs, without however seriously impairing the strength of the container or the imperviousness or elegance thereof. Experience has shown that, when instead of the inverted V cuts or cut outs, or configurations of that general type, as shown in FIGS. 3 and 17 at 30 and 330, one employs a reverse configuration, with the broad end base of the triangle adjacent to the top edge of the container, or some other similar configuration having a relatively broad cut or cut out portion in relatively close relationship to the top edge of the container wall, not only is the stability of the container somewhat impaired, together with its imperviousness to liquid, moisture, and moisture-vapor transfer, but also that the elegance of the container structure at the upper and most visible edges thereof is considerably impaired. Accordingly, although not essential for general operativeness of the invention, in their preferred form, the areas of low resistance provided in edge-reinforcing flaps such as 9–12 and 309–312, whether in the form of cuts 30 or cut-outs 330, will have their apex or smaller portion upwardly extending when in place in the erected carton, and any broader base downwardly extending, that is, furthermost removed from the top or upper edge of the container body wall. Moreover, the inverted V-shape, or a configuration of that general nature, having its apex upwardly-disposed nearest adjacent the edge of the container wall, has also been found preferable and most suitable for superior interlocking with closure member lugs of the same or similar interlocking or interfitting configuration. As to the number of lugs 60 in any particular closure member 50, depending upon size and shape of the container to be closed, the number may be varied within reasonable limits, e.g., usually four to eight, and of course the number of cuts 30 or cut-outs 330 generally and preferably corresponds to the number of lugs employed in the complementary closure member.

The closure member of the invention, as previously stated, is preferably constructed of thermoplastic material. Such thermoplastic or plastic material must of course be FDA-approved for use in the packaging of foodstuffs, as is well known to one skilled in the art. Representative suitable thermoplastic materials are the heat-deformable plastic materials such as polyethylene, polypropylene, polystyrene, copolyesters such as that sold under the trademark "Lustro", acrylics and modified acrylics such as that sold under the trademark "Cyrolite", ABS polymers, and many more which will be apparent to one skilled in the art.

The adhesive employed in the specified glue areas for adhering various members of the container may be of any suitable or conventional type. For example, ordinary glue may be employed, conventional hot-melt adhesives may be employed or, in a non-preferred embodiment, the adhesive may be pre-applied and heat-activatable by application of heated mandrels or plates during the sealing operation. However, for effecting the side-sealing at the manufacturer's joint, as well as securing bottom-forming members, ordinary glue or hot-melt is entirely satisfactory and is accordingly preferred. For securing the edge-reinforcing flaps to their adjacent wall panels, hot-melt or other heat-activatable adhesive is preferred, in view of the fact that it is sometimes desirable, as previously indicated, to punch lugs in the inner upstanding wall of the closure member of the invention into areas of low resistance in the edges areas of the upstanding container walls and adhere them there in place in the areas of said low resistance. This is most conveniently accomplished by using a heated punch against a mandrel located on the outside of the container closure member, which serves to activate the heat-activatable or hot-melt adhesive at the same time as it punches the lugs of the inner upstanding wall of the closure member into the areas of low resistance in the upper edge areas of the upstanding container walls, whether or not the said lugs are pre-formed in the said container closure member or whether they are formed therein by the said punching operation as a part of the container closing operation, with or without the application of heat, as may be desired in a particular case.

When the lugs of the upstanding inner wall of the closure member are punched into the areas of low resistance in the edge areas of the upstanding container walls and secured therein by adhesive, whether with or without heat, an extremely secure bond is formed between the said lugs and the areas of low resistance in the container walls. This is of particular advantage when it is desired to affix the container closure member to the reinforced end of the tube of FIG. 4 to produce a closed-end tube of FIG. 5*a* and then proceed to fill the same with semi-solid ice cream product in the usual manner. However, even when the closure member is affixed last, and the semi-solid ice cream product is filled into a container of the invention according to FIG. 5 to produce a filled and closed container according to FIG. 6, the subsequent procedure is the same. Whether the filled container is that of FIG. 6 or FIG. 6*a*, the usual procedure for providing the finished ice cream product package is to store the filled container in a so-called "hardening room" for a period of time up to several days at a temperature below about zero degrees centigrade, and usually at or about minus thirty degrees centigrade. When the closed container is that of FIG. 6, the thus solidified ice cream product assists in maintaining stability of the bottom-forming members at the bottom of the container and, when the finished package is that of FIG. 6*a*, the frozen ice cream product assists greatly in the solidification and rigidification of the closure between the container walls and the end closure member of the invention. In either case, however, the adherence of the lugs of the closure member by means of the adhesive, if any, employed for increasing the interlock between the lugs of the closure member of the invention and the area of low-resistance in the edge-reinforcing flaps of the container according to the invention presents no problem, inasmuch as the package is in such case merely subjected to the said reduced temperature in the said hardening room for a period of time sufficient not only to cause solidification of the semi-solid ice cream product contained therein, but also sufficient to cause separation of the lugs in the container closure member from the said adhesive, thereby effecting enhanced releasability of the container closure member from the container at the time of consumer use.

In the event it is desired either to form or extend lugs in the inner upstanding wall of the container closure member at the time of closing a container of the invention with a container closure member of the invention, either with or without the application of heat for purposes of activating or reactivating heat-activatable or hot-melt adhesive in the areas of low resistance in the edge-reinforcing flaps of the container, this may of course be done by hand, with a hand-held punch or heater, or both, either simultaneously or sequentially, or a device may be employed for carrying out such step or steps. Such a device may conveniently comprise a fastening-head having a plurality, e.g., four to eight, punching points located therein, and with or without corresponding heating units also located at said punching points, adapted to fit within and/or around the closure member of the invention and to deliver simultaneous suitably-localized sharp punching blows to the preselected designated areas which either are already lugs or which are designed to be lugs in the inner upstanding wall of the closure member of the invention. A device particularly adapted for use in such manner, that is, for punching preexisting lugs formed in the inner upstanding wall of the closure member of the invention into closer contact with complementary areas of low resistance in the edge areas of the container walls, or to perform the same function in preselected areas of the said inner upstanding wall of the closure member in which lugs have not been preformed, either with or without the employment of heat for temporarily locally heat-deforming the thermoplastic material, of which the closure member is constructed, to facilitate the aforementioned punching for lug formation or extension and/or for activating or reactivating heat-activatable adhesive or hot-melt adhesive in the said areas of low resistance in the edge-reinforced areas, is disclosed in the copending application of Richard G. Haas, Ser. No. 71,243, entitled "Container Closing Machine", filed even date herewith. In this application is disclosed apparatus for performing the aforesaid functions of punching and/or heating, by means of a fastening head, in a machine particularly designed for the aforesaid purpose or purposes and for ensuring adequate securement of a closure member of the type provided according to the present invention to a container of the type provided according to the present invention by means of lugs in the closure member extending into areas of low resistance in the upstanding walls of the container. As already stated, although such functions can be performed by hand, it goes without saying that the employment of a machine designed for the express purposes is of great advantage and the procedure of choice.

In an obvious alternative embodiment of the invention, it is apparent that reinforcing flaps 9–12 or 309–312 may carry or receive suitable adhesive and be folded down upon the container body walls 1–4 or 301–304 on the exterior thereof and adhesively secured thereto on the exterior rather than on the interior of the container body. In such embodiment, it is also obvious that the glue flap 14 or 314, appended to the container body side wall 4 or rear wall 1, or 304 or 301, as shown appended to the carton side wall 4 or 304, would still most advantageously be folded inside of the adjacent container body 1, 301 and adhesively secured thereto on the interior thereof, although securement to the exterior thereof would also provide an operative structure.

As is conventional, the material of construction of the container body of the present invention may suitably comprise the normal paperboard, with the usual filler and interior and exterior liners. The exterior liner may, as usual, be suitably clay-coated, and both of the liners may be, and preferably are, also wax-coated in areas to be non-adhering.

Also as conventional, the adhesive employed may be any one of the usual hot-melt adhesives, a pressure-sensitive adhesive, glue, or the like. Numerous alternatives are available and will readily be apparent to one skilled in the art. Heat activatable, and especially hot-melt adhesives, are generally preferred, especially for securing the reinforcing flaps to their adjacent walls.

From the foregoing, it will be seen that all of the objectives of the invention have been attained, and in a ready, facile, and economical manner. A compact and elegant container with complementary closure member for filling with ice cream product, including products such as sherbet, milk ice, or the like, has been provided, as well as the filled package, and blanks for producing the container body and the assembled combination, and in which structure sheetform material, e.g., paperboard, of lesser caliper than previously employed may be used, because of the superior structural aspects of the invention, especially the edge-reinforcing flaps, which provide a double thickness of board in areas of usual weakness. These edge-reinforcing flaps of the container body provide a rim or edge, upon opening of the container, which is not readily subject to wicking or permeation by moisture or fluid contents, so that the container is adapted to maintain its elegance even upon opening. Moreover, the container, once sealed, is readily and conveniently opened and, due to the unique complementary relationship between the container closure member and container body according to the present invention, not only is the closure member adapted for ready opening and closing once the container has been opened, but also for a particularly close fit and improved frictional contact along the reinforced edges of all of the container walls upon reclosure. Such advantages are not possible with structures in which both the carton cover and the carton body are erected from a single integral blank.

The invention, then, in its most significant and multifaceted aspects, can be described as follows:

An integral blank cut and scored to provide a tubular container comprising substantially rectangular rear, side, and front wall members, a glue flap articulated along a score to one of said container wall members and adapted to be adhered to an adjacent container wall member, bottom-forming flaps articulated to each of said wall members along scores at one end of said blank, and edge-reinforcing flaps articulated to each of said container rear, side, and front wall members at the other end of said blank having areas of low resistance defined therein and being adapted to be folded over and adhesively secured to said adjacent wall members to which said flaps are articulated, thereby to form a folded-over, reinforced portion of double thickness at that end of said blank and in a tubular container erected from said blank, with said areas of low resistance being present in the inner exposed surface of folded-over edge-reinforced portions of the walls of said container erected from said blank; such an integral blank wherein at least two of said bottom-forming flaps are adapted to be outer bottom-forming flaps upon erection of a container from said blank, said two flaps being adapted to be adhesively secured to the other bottom-forming flaps which are adapted to be interior bottom-forming flaps upon erection of a container from said blank; such an integral blank wherein said glue flap is articulated to said container rear wall or side wall member and wherein two bottom-forming flaps adapted to be exterior bottom-forming flaps are of dimensions so that one overlaps the other upon erection of a container from said blank; such an integral blank wherein said areas of low resistance are defined by cuts in said edge-reinforcing flaps; such an integral blank wherein said areas of low resistance are defined by cut-out areas in said edge-reinforcing flaps; such an integral blank wherein said areas of low resistance are defined by generally V-shaped cuts in said edge-reinforcing flaps; such an integral blank wherein said areas of low resistance are defined by generally V-shaped cut-out areas in said edge-reinforcing flaps; such an edge-reinforced integral blank having said edge-reinforcing flaps folded over and adhesively secured to the wall members of said blank to form a folded-over, reinforced portion of double thickness at that end of the blank; a tube erected from such a preceding integral blank, having its wall members connected by means of said glue flap, and having its bottom-forming flaps outwardly extending in an unfolded and non-secured position and such a tube, folded over upon itself and in the form of a flat-folded tube; a container erected from such a preceding integral blank, having its wall members connected by means of said glue flap, and having its bottom-forming flaps folded over and secured to each other thereby forming the container bottom; a container erected from such a preceding integral blank, having its wall members connected by means of said glue flap, having its bottom-forming flaps outwardly extending in an unfolded and non-secured position, and having its reinforced end closed by a closure member comprising:

an upstanding tubular inner wall conforming to the inner surfaces of the walls of the container, and a downstanding tubular outer wall connected thereto by a bight and conforming to the outer surfaces of the walls of the container, said inner and outer walls and said bight forming a tubular channel in which said upstanding walls of said tubular container are seated in frictional engagement, a centrally-located upwardly-elevated dome portion, defined by an upstanding dome-forming wall which is inwardly spaced from the said upstanding tubular inner wall of said closure member, the said two upstanding walls of said closure member defining a tubular valley therebetween, and lugs formed in said upstanding tubular inner wall, said lugs complementarily extending into said areas of low resistance in the inner exposed surface of the walls of said container at the end thereof closed by the closure member, for releasably securing said container closure member to said tubular container walls; a container erected from such a preceding integral blank, having its wall members connected by means of said glue flap, having its bottom-forming flaps outwardly extending in an unfolded and non-secured position, and having its reinforced end closed by the closure member as described hereinafter. Also a closure member, suitable for use in closing a tubular container having upstanding walls comprising areas of low resistance defined in the inner exposed surface of the edge areas of said upstanding walls, comprising:

an upstanding tubular inner wall conforming to the inner surfaces of the walls of the container to be closed by said closure member, and a downstanding tubular outer wall connected thereto by a bight and conforming to the outer surfaces of the walls of the container to be closed by said closure member, thereby forming a tubular channel in which said upstanding walls of said tubular container can be seated in frictional engagement, a centrally located upwardly-elevated dome portion, defined by an upstanding dome-forming wall which is inwardly spaced from the said upstanding tubular inner wall of said closure member, the said two upstanding walls of said closure member defining a tubular valley therebetween, and lugs formed in said upstanding tubular inner wall, said lugs being for complementarily extending into said areas of low resistance in the inner exposed surface of the walls of the container to be closed by the closure member, for releasably securing said container closure member to said tubular container; such a closure member made of a thermoplastic material; such a closure member wherein said downstanding tubular outer wall has an outwardly-flaring skirt portion to facilitate placement of said closure member on a container to be closed thereby; such a closure member comprising nesting means, to facilitate vertical stacking or feeding of a plurality of said closure members, in the form of a step having a vertical riser and a horizontal tread in one of said upstanding walls defining said tubular valley; such a closure member comprising a laterally-extending pull-tab at the lower edge of said downstanding outer wall. Also a tubular container having a bottom and upstanding walls, the end edges of which walls are folded-over and adhered to said walls to form a folded-over, reinforced portion of double thickness at that end of the tubular container, the inner exposed surface of said folded-over, edge-reinforced portions of the upstanding walls of said container having areas of low resistance defined therein for facilitating the removable securement of a container closure member thereto; such a tubular container, wherein said areas of low resistance are defined by cuts in said edge-reinforced portions; such a tubular container, wherein said areas of low resistance are defined by cut-out areas in said edge-reinforced portions; such a tubular container, wherein said areas of low resistance are defined by generally inverted-V-shaped cuts in said edge-reinforced portions; such a tubular container, wherein said areas of low resistance are defined by generally inverted-V-shaped cut-out areas in said edge-reinforced portions; such a tubular container, wherein said end edges are folded over inwardly so as to provide said reinforced portion on the container interior; such a tubular container, having a rectangular cross-section; such a tubular container, constructed of paperboard; and such a tubular container, wherein said end edges are adhered by means of heat-activatable or hot-melt adhesive; and such a container, having its reinforced end closed by the closure member as previously described; and such a container having a bottom and upstanding walls, the end edges of which walls are folded-over and adhered to said walls to form a folded-over, reinforced portion of double thickness at that end of the tubular container, the inner exposed surface of said folded-over, edge reinforced portions of the upstanding walls of said container having areas of low resistance defined therein for facilitating the removable securement of a container closure member thereto, closed by the container closure member as described. Also a closed tubular container having a bottom and upstanding walls, the end edges of which walls are folded-over and adhered to said walls to form a folded-over, reinforced portion of double thickness at that end of the tubular container, the inner exposed surface of said folded-over, edge-reinforced portions of the upstanding walls of said container comprising areas of low resistance defined therein for facilitating the removable securement of a container closure member thereto and, removeably secured thereto, a closure member, comprising:

an upstanding tubular inner wall conforming to the inner surfaces of the walls of the container, and a downstanding tubular outer wall connected thereto by a bight and conforming to the outer surfaces of the walls of the container, said inner and outer walls and said bight forming a channel in which said upstanding walls of said tubular container are seated in frictional engagement, a centrally-located upwardly-elevated dome portion, defined by an upstanding dome-forming wall which is inwardly spaced from the said upstanding tubular inner wall of said closure member, the said two upstanding walls of said closure member defining a tubular valley therebetween, and lugs formed in said tubular inner wall, said lugs complementarily extending into said areas of low resistance in the inner exposed surface of the walls of said container, thereby releasably securing said container closure member to said tubular container; such a combination, wherein said areas of low resistance are defined by cuts in said edge-reinforced portions; such a combination, wherein said areas of low resistance are defined by cut-out areas in said edge-reinforced portions; same wherein said areas of low resistance are defined by generally inverted-V-shaped cuts; same wherein said areas of low resistance are defined by generally inverted-V-shaped cut-out areas; such a combination wherein said lugs are of a configuration adapted to interlock with said areas of low resistance, especially such inverted-V-shaped cuts or cut-outs; such a combination wherein said closure member is of a thermoplastic material; such a tubular container, wherein said downstanding tubular outer wall of said closure member has an outwardly-flaring skirt portion to facilitate placement of said closure member on said container; such a tubular container, wherein said closure member comprises nesting means, to facilitate vertical stacking or feeding of a plurality of said closure members, in the form of a step having a vertical riser and a horizontal tread in one of said upstanding walls defining said valley, and a laterally extending pull-tab at the lower edge of said downstanding outer wall; such a combination, wherein said end edges are folded over inwardly so as to provide said reinforced portion on the container interior; such a combination, having a rectangular cross-section; such a combination, wherein the container is constructed of paperboard; and such a combination, wherein said end edges of said container are adhered by means of heat-activatable or hot-melt adhesive. Also, a container or closed container as hereinbefore described filled with ice cream product. Also, a method of closing an open end of a tube or tubular container as herein described, comprising the steps of placing a container closure member as herein described onto the reinforced end of said tube or tubular container and forcing the lugs in the upstanding tubular inner wall of said closure member into the complementary areas of low resistance in the inner exposed surface of the walls of the said tube or tubular container; such a method which includes the step of adhering said lugs in said areas of low resistance by means of adhesive in said areas of low resistance; and such a method, wherein said adherence is effected by means of heat-activatable or hot-melt adhesive in said areas. Also, a method of packaging ice cream product comprising the steps of filling semi-solid ice cream product into such a container as hereinbefore described having its reinforced end closed with a closure member as hereinbefore described, closing the bottom-forming flaps on the open end of said container and adhering them to each other, and subjecting the package to hardening at a temperature below about zero degrees centigrade to solidify the semi-solid ice cream product; and a method of packaging ice cream product comprising the steps of filling semi-solid ice cream product into a container as hereinbefore described, having its bottom formed by closed and adhered bottom-forming flaps, closing the reinforced end of said container with a closure member as hereinbefore described, and then subjecting the package to hardening at a temperature below about zero degrees centrigrade to solidify the semi-solid ice cream product; and such methods wherein the lugs in the upstanding tubular inner wall of the closure member are adhered in the complementary areas of low resistance in the inner exposed surface of the wall of the container by heat-activatable or hot-melt adhesive, and wherein the package is subjected to said reduced temperature for a period of time sufficient to cause separation of the said lugs in the container closure member from the said adhesive, thereby effecting enhanced releasability of said container closure member from said container.

It is, however, to be understood that the invention is not limited to the exact details of construction, operation, or exact materials or embodiments shown and described, as obvious modifications and equivalents will be apparent to one skilled in the art, wherefore in the invention is to be limited only by the full scope of the appended claims.

I claim:

1. A method of packaging ice cream product comprising the steps of filling semi-solid ice cream product into a tubular container formed from an integral blank which is cut and scored to provide a tubular container comprising substantially rectangular rear, side, and front wall members, a glue flap articulated along a score to one of said container wall members and adhered to an adjacent container wall member, bottom-forming flaps articulated to each of said wall members along scores at one end of said blank, and edge-reinforcing flaps articulated to each of said container rear, side, and front wall members at the other end of said blank having areas of low resistance defined therein and being folded over and adhered to said adjacent wall members to which said flaps are articulated, thereby to form a folded-over, reinforced portion of double thickness at that end of the tubular container erected from said blank, with said areas of low resistance being present in the inner exposed surface of folded-over edge-reinforced portions of the walls of said container, having its wall members connected by means of said glue flap, having its bottom-forming flaps outwardly extending in an unfolded and non-secured position, and having its reinforced end closed by a closure member comprising:

an upstanding tubular inner wall conforming to the inner surfaces of the walls of the container, and a downstanding tubular outer wall connected thereto by a bight and conforming to the outer surfaces of the walls of the container, said inner and outer walls and said bight forming a tubular channel in which said upstanding walls of said tubular container are seated in frictional engagement, a centrally-located upwardly-elevated dome portion, defined by an upstanding dome-forming wall which is inwardly spaced from the said upstanding tubular inner wall of said closure member, the said two upstanding walls of said closure member defining a tubular valley therebetween, and lugs formed in said upstanding tubular inner wall, said lugs complementarily extending into said areas of low resistance in the inner exposed surface of the walls of said container at the end thereof closed by the closure member, for releasably securing said container closure member to said tubular container walls, closing the bottom-forming flaps on the open end of said container and adhering them to each other, and subjecting the package to hardening at a temperature below about zero degrees centigrade to solidify the semi-solid ice cream product.

2. A method of packaging ice cream product comprising the steps of filling semi-solid ice cream product into a tubular container formed from an integral blank which is cut and scored to provide a tubular container comprising substantially rectangular rear, side, and front wall members, a glue flap articulated along a score to one of said container wall members and adhered to an adjacent container wall member, bottom-forming flaps articulated to each of said wall members along scores at one end of said blank, and edge-reinforcing flaps articulated to each of said container rear, side, and front wall members at the other end of said blank having areas of low resistance defined therein and being folded over and adhered to said adjacent wall members to which said flaps are articulated, thereby to form a folded-over, reinforced portion of double thickness at that end of the tubular container erected from said blank, with said areas of low resistance being present in the inner exposed surface of folded-over edge-reinforced portions of the walls of said container, having its wall members connected by means of said glue flap, and having its bottom-forming flaps folded over and secured to each other thereby forming the container bottom, and having its bottom-forming flaps folded over and secured to each other thereby forming the container bottom, closing the reinforced end of said container with a closure member, comprising an upstanding tubular inner wall conforming to the inner surfaces of the walls of the container, a downstanding tubular outer wall connected thereto by a bight and conforming to the outer surfaces of the walls of the container, thereby forming a tubular channel in which said upstanding walls of said tubular container are seated in frictional engagement, a centrally located upwardly-elevated dome portion, defined by an upstanding dome-forming wall which is inwardly spaced from the said upstanding tubular inner wall of said closure member, the said two upstanding walls of said closure member defining a tubular valley therebetween, providing lugs in said upstanding tubular inner wall, said lugs complementarily extending into said areas of low resistance in the inner exposed surface of the walls of the container closed by the closure member, for releasably securing said container closure member to said tubular container, and then subjecting the package to hardening at a temperature below about zero degrees centrigrade to solidify the semi-solid ice cream product.

3. Method of claim 1 or 2, wherein the lugs in the upstanding tubular inner wall of the closure member are adhered in the complementary areas of low resistance in the inner exposed surface of the wall of the container by heat-activatable or hot-melt adhesive, and wherein the package is subjected to said reduced temperature for a period of time sufficient to cause separation of the said lugs in the container closure member from the said adhesive, thereby effecting enhanced releasability of said container closure member from said container.

4. A method of packaging ice cream product comprising the steps of filling semi-solid ice cream product into a tubular container said container comprising substantially rectangular rear, side, and front wall members, a glue flap articulated along a score to one of said container wall members and adhered to an adjacent container wall member, bottom-forming flaps articulated to each of said wall members along scores at one end of said container and outwardly extending in an unfolded and non-secured position, and edge-reinforcing flaps articulated to each of said container rear, side, and front wall members at the other end of said container having areas of low resistance including adhesive-containing areas therein, said edge reinforcing flaps being folded over and adhesively secured to the wall members of said container to form a folded-over-reinforced portion of double thickness at that end of the tubular container, with said areas of low resistance including adhesive-containing areas being present in the inner exposed surface of folded-over edge-reinforced portions of the walls of said tubular container, said container having its reinforced end closed by a closure member comprising:

an upstanding tubular inner wall conforming to the inner surfaces of the walls of the container, and a downstanding tubular outer wall connected thereto by a bight and conforming to the outer surfaces of the walls of the container, said inner and outer walls and said bight forming a tubular channel in which said upstanding walls of said tubular container are seated in frictional engagement, and lugs formed in said upstanding tubular inner wall, said lugs complementarily extending into said areas of low resistance and being adhesively secured to corresponding adhesive-containing areas in the inner exposed surface of the walls of said container at the end thereof closed by the closure member, for releasably securing said container closure member to said tubular container walls, closing the bottom-forming flaps on the open end of said container and adhering them to each other, and subjecting the package to hardening at a reduced temperature below about zero degrees centigrade to solidify the semi-solid ice cream product, wherein the package is subjected to said reduced temperature for a period of time sufficient to cause separation of the said lugs in the container closure member from the adhesive, thereby effecting enhanced releasability of said container closure member from said container.

5. The method of claim 4, wherein said lugs are of a configuration adapted to coincide with the configuration of the corresponding adhesive-containing areas in the edge reinforced portions of the upstanding walls of said container.

6. The method of claim 4, wherein said lugs are of a configuration adapted to coincide with said areas of low resistance in the form of cut or cut-out areas in said edge-reinforced portions.

7. The method of claim 4, wherein said adhesive is a hot-melt or heat-activatable adhesive.

* * * * *

UNITED STATES PATENT AND TRADEMARK OFFICE

CERTIFICATE OF CORRECTION

PATENT NO. : 4,363,821

DATED : December 14, 1982

INVENTOR(S) : Thomas VanderLugt, Jr.

It is certified that error appears in the above-identified patent and that said Letters Patent is hereby corrected as shown below:

Col 19, line 10: "the adhesive" - should read:
"the said adhesive" (Claim 6, Schedule A, line 41)

Signed and Sealed this

*Fourteenth* Day of *June 1983*

[SEAL]

*Attest:*

DONALD J. QUIGG

*Attesting Officer*

*Acting Commissioner of Patents and Trademarks*